US007246392B2

(12) United States Patent
Schmid et al.

(10) Patent No.: US 7,246,392 B2
(45) Date of Patent: Jul. 24, 2007

(54) WEARABLE BLANKET AND A SWADDLING ACCESSORY THEREFOR

(75) Inventors: William R. Schmid, Plymouth, MN (US); Dawn Griffin, Eden Prairie, MN (US)

(73) Assignee: Halo Innovations, Inc., Plymouth, MN (US)

( * ) Notice: Subject to any disclaimer, the term of this patent is extended or adjusted under 35 U.S.C. 154(b) by 0 days.

(21) Appl. No.: 11/223,438

(22) Filed: Sep. 9, 2005

(65) Prior Publication Data

US 2007/0056098 A1 Mar. 15, 2007

(51) Int. Cl.
*B68G 5/00* (2006.01)
*A47G 9/00* (2006.01)
*A41B 16/06* (2006.01)

(52) U.S. Cl. ..... 5/655; 5/482; 2/69.5

(58) Field of Classification Search ..... 5/482, 5/494, 655; 2/69.5, 86, 89, 111
See application file for complete search history.

(56) References Cited

U.S. PATENT DOCUMENTS 2,227,751 A * 1/1941 Idelman ..... 2/69.5
2,439,101 A * 4/1948 Rogers ..... 2/114
2,578,323 A 12/1951 Sillaway
3,739,399 A * 6/1973 Sheahon ..... 2/69.5
4,253,197 A 3/1981 Posta
4,517,910 A 5/1985 Jalowsky
4,530,349 A 7/1985 Metzger
4,627,110 A 12/1986 Tengs
4,999,848 A 3/1991 Oney
5,097,534 A 3/1992 Viemeister et al.
5,121,505 A 6/1992 Ludmer et al.
5,129,406 A * 7/1992 Magnusen et al. ..... 128/873
5,241,300 A 8/1993 Buschmann
5,282,749 A 2/1994 Ketch
5,379,461 A 1/1995 Wilmers
5,423,139 A 6/1995 Feldman (Continued)

FOREIGN PATENT DOCUMENTS

WO WO 02/01975 A1 1/2002

OTHER PUBLICATIONS

L'Hoir et al. "Risk and preventive factors for cot death in the Netherlands, a low-incidence country" Preventive Pediatrics and Epidetiology, pp. 681-688, 1998.

(Continued)

*Primary Examiner*—Patricia Engle
*Assistant Examiner*—Gilbert Lee
(74) *Attorney, Agent, or Firm*—Hamre, Schumann, Mueller & Larson, P.C.

(57) ABSTRACT

A swaddling accessory attachable to a wearable blanket for use in swaddling an infant. The wearable blanket can be used with or without the swaddle to give the caregiver the option of using the wearable blanket without the swaddling accessory. The swaddling accessory and wearable blanket are equipped with fasteners that allow the swaddling accessory to be detachably secured to the wearable blanket in different positions relative to the blanket. The fasteners are positioned to prevent the swaddling accessory from being wrapped too high on the infant's body where it could potentially cover a portion of the mouth or nose. The infant's legs are left free to flex within the wearable blanket which helps to prevent hip dysplasia.

5 Claims, 3 Drawing Sheets

U.S. PATENT DOCUMENTS 5,437,061 A * 8/1995 Kenner ..... 2/69.5
5,468,152 A 11/1995 Lenart
5,479,661 A 1/1996 Fingleson et al.
5,581,815 A 12/1996 Hans
5,606,748 A 3/1997 Fujiwara
5,621,917 A * 4/1997 Howsden ..... 2/111
5,718,589 A 2/1998 McCracken et al.
5,722,094 A * 3/1998 Ruefer ..... 2/69.5
5,745,918 A 5/1998 Shukla et al.
5,914,660 A 6/1999 Mesibov et al.
5,918,316 A 7/1999 Nathanson et al.
D413,423 S * 9/1999 Forrest ..... D2/718
6,009,576 A * 1/2000 Gramme et al. ..... 5/413 R
6,049,912 A 4/2000 Linehan
6,076,194 A 6/2000 Purkett
6,128,794 A * 10/2000 Pariseau ..... 5/413 R
6,142,785 A 11/2000 Williams
6,185,746 B1 2/2001 Scott
6,272,683 B1 * 8/2001 Symms et al. ..... 2/69.5
6,397,390 B1 6/2002 Henderson et al.
6,662,390 B1 * 12/2003 Berger ..... 5/486
6,686,843 B2 2/2004 Felkowitz
6,817,033 B2 * 11/2004 Bailey ..... 2/69.5
2004/0006805 A1 1/2004 Broeksmit
2004/0019969 A1 * 2/2004 Gatten ..... 5/482
2004/0139527 A1 * 7/2004 Damir et al. ..... 2/83
2005/0210585 A1 * 9/2005 French ..... 5/494

OTHER PUBLICATIONS

Pregnancy Magazine, "Get Ready Best Bets: Sweet Dreams: Make bedtime safe and cozy with a cuddly wearable blanket."; Oct. 2005 edition; p. 80.

* cited by examiner

WEARABLE BLANKET AND A SWADDLING ACCESSORY THEREFOR

FIELD

This disclosure describes a wearable blanket and an accessory for swaddling an infant. More particularly, this disclosure describes an accessory attachable to a wearable blanket for use in swaddling an infant.

BACKGROUND

A wearable blanket is commonly used in lieu of a blanket to keep an infant warm while sleeping in the blanket-free environment currently recommended by pediatric experts and experts in Sudden Infant Death Syndrome (SIDS). A wearable blanket is a garment that fully encloses both legs in one compartment or "bag" and has a sleeveless design to eliminate bulky sleeves that could, when placed proximate to the face, cause a microenvironment for rebreathing exhaled carbon dioxide. Rebreathing (i.e. the inhalation of carbon dioxide) is thought to be a possible cause of SIDS. The sleeveless design also eases the task of putting on and taking off the wearable blanket. An example of a wearable blanket is the SleepSack™ wearable blanket available from Halo Innovations, Inc. of Plymouth, Minn.

Swaddling of infants has been a common practice around the world for thousands of years. Swaddling, which is wrapping or binding around an infant, has traditionally been practiced using a blanket or strips of cloth which are tightly wrapped around the infant.

It is believed that this wrapping or binding comforts an infant and allows them to sleep more soundly. The reasons for this may be many. The snugness of the swaddle may feel, to an infant, like the snugness of the womb they left, giving them a greater sense of security. The swaddle, when used to bind the arms, may also prevent an infant's startle reflex from waking them up. The chest and abdominal pressure generated by the swaddle may even relieve colic which is thought to cause a "fussy" baby. Prior to the use of cribs and a safe nursery environment, a swaddle would also keep an older baby from crawling away when a caregiver was not watching.

The importance of a swaddle today is even greater with the advent of the Back to Sleep™ campaign which encourages parents and caregivers to place babies to sleep on their backs (i.e. supine position), a position which has been shown to reduce the risk of SIDS. Many infants do not tolerate this sleep position well, but tolerate it better when swaddled. In this case, the gentle chest pressure generated by the swaddle may be comforting to them similar to if the infant is sleeping on their stomachs (i.e. prone position).

While many infants tolerate swaddling, there are many that do not. One does not know until they try it. Further, while there is a "right" way and a "wrong" way to swaddle, most parents are left to learn this on their own, as most hospitals fail to teach proper swaddling to the parents of newborns.

There are, however, risks to swaddling. If swaddled improperly, an infant can easily work out of the swaddle, creating a loose blanket which has been shown to increase the risk of SIDS or strangulation. If they do not completely free themselves, the swaddle may migrate over their face, creating an equally dangerous situation. Even the best-swaddled infants will eventually free themselves as they get older. Further, if bound too tight, a swaddle can inhibit chest wall movement, compromising an infant's ability to breathe normally. In addition, if the swaddle binds the infant's legs preventing them from flexing and abducting normally, this may lead to the development of hip dysplasia.

SUMMARY

A swaddling accessory attachable to a wearable blanket for use in swaddling an infant. The wearable blanket can be used with or without the swaddle, and gives the caregiver the option of using the wearable blanket without the swaddling accessory depending on how well the infant tolerates swaddling.

The swaddling accessory and wearable blanket are equipped with fasteners that allow the swaddling accessory to be detachably secured to the wearable blanket. In one embodiment, the fasteners are positioned to allow the swaddling accessory to be attached in either a "high" or "low" position relative to the wearable blanket. When at the "high" position, the swaddling accessory is positioned to enclose the arms of the infant. When at the "low" position, the swaddling accessory will enclose only the torso of the infant, leaving the arms free. The fasteners are positioned to prevent the swaddling accessory from being wrapped too high on the infant's body where it could potentially cover a portion of the mouth or nose.

The swaddling accessory has a maximum width and a maximum length. The maximum width is chosen so that the swaddling accessory will primarily cover the torso and/or arms of the infant (depending upon whether the swaddling accessory is in the high or low position), while leaving the legs free to flex within the wearable blanket which helps prevent hip dysplasia. The length of the swaddling accessory is selected so that the swaddling accessory is long enough to fully and securely wrap the infant, with large enough fasteners to securely keep the swaddling accessory in place and securely close the swaddle to provide a snug and secure fit.

In one embodiment, the wearable blanket is provided with a hole near the base thereof and positioned in-line with a closure mechanism, such as a zipper. When in a hospital environment or at home, a number of tubes and/or wires from monitoring mechanisms may be attached to the infant. Those tubes or wires can be run inside the wearable blanket to help keep the tubes or wires in place. The hole allows the passage of tubes and wires to the outside of the wearable blanket. By positioning the holes near the base of the wearable blanket, interference from the swaddle accessory is avoided. Further, because the hole is in-line with the closure mechanism, the wearable blanket can be removed from the infant without having to disconnect the tubes or wires.

DETAILED DESCRIPTION

Figure 1:
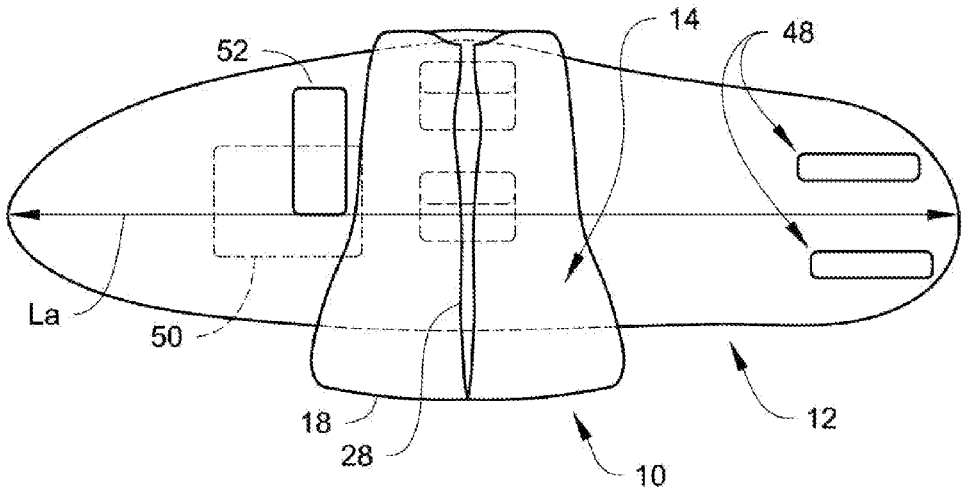
FIG. 1 is a front view of a wearable blanket together with a swaddling accessory attached to the wearable blanket in a first, "high" position.

A wearable blanket for an infant and a swaddling accessory attachable to the wearable blanket are provided. The wearable blanket is provided with one or more fasteners that allow the swaddling accessory to be detachably attached thereto. Preferably, the fasteners permit the swaddling accessory to be connected to different locations on the wearable blanket. Further, a wearable blanket is also provided with at least one hole therethrough that allows passage of tubes and/or wires connected to the infant. Preferably, the hole is positioned to allow the wearable blanket to be put on and taken off the infant without having to disconnect the tubes or wires.

The swaddling accessory is provided with one or more fasteners for detachable connection with the fastener(s) of the wearable blanket. The swaddling accessory is also provided with fasteners at the ends thereof to enable the ends to be detachably connected when the swaddling accessory is wrapped around an infant.

With reference now to FIGS. 1-4, an exemplary embodiment of a wearable blanket 10 and a swaddling accessory 12 will be described. The wearable blanket 10 is a garment that fully encloses both legs of an infant in one compartment or "bag". The wearable blanket 10 has a front 14, a back 16, a closed bottom edge 18, a neck hole 20 at the top through which an infant's neck extends, and armholes 24, 26 through which the infant's arms extend. The front 14 is divided into separate portions 14*a*, 14*b* through which the blanket 10 is disposed on an infant. A closure mechanism 28, for example a zipper, extends from the neck hole 20 to near the bottom edge 18 to connect the portions 14*a*, 14*b* together.

The wearable blanket can be made of a number of materials suitable for an infant, for example cotton or fleece.

Figure 5:
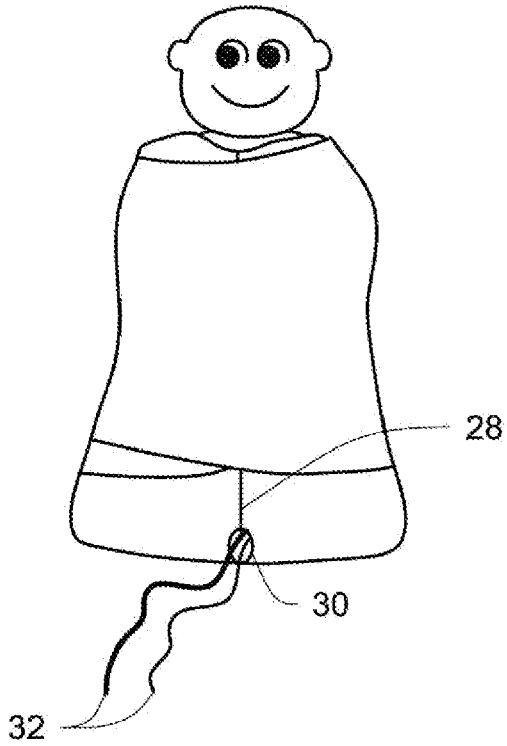
FIG. 5 illustrates the use of the wearable blanket and swaddling accessory on an infant with the swaddling accessory in the first, "high" position.

A hole 30 is provided adjacent the closed bottom edge 18 in-line with and at the termination of the closure mechanism 28. As shown in FIG. 5, the hole 30 allows passage of tubes and/or wires 32 that are connected to the infant and which are run inside the blanket 10 to help keep the tubes and/or wires in place and out of reach of the infant. Because the hole 30 is in-line with the closure mechanism 28, the hole 30 can be opened when the closure mechanism 28 is opened, thereby allowing the blanket 10 to be put on and taken off of the infant without having to disconnect the tubes and/or wires 32 from the infant.

Figure 4:
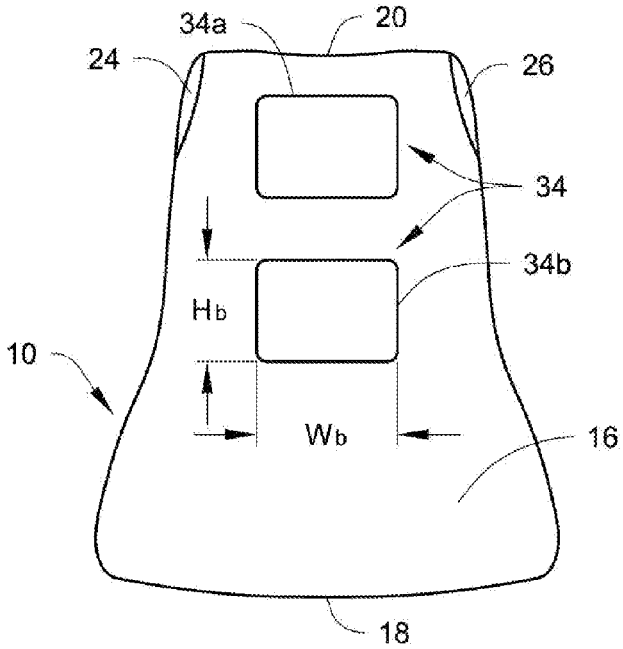
FIG. 4 is a rear view of the wearable blanket illustrating an example of the positions of fasteners for connecting with the swaddling accessory.

As shown in FIG. 4, the back 16 of the blanket 10 is provided with a fastener 34 for cooperating with a fastener (to be later described) on the swaddling accessory 12, for detachably connecting the swaddling accessory 12 to the blanket 10. For example, the fastener 34 comprises a pair of loop patches 34*a*, 34*b* forming part of a hook and loop fastening connection between the blanket 10 and swaddling accessory 12. Although separate patches, 34*a*, 34*b* have been illustrated, it is to be realized that the fastener 34 could comprise a single loop patch, or the two patches 34*a*, 34*b* could be combined into a single larger loop patch.

The loop patches 34*a*, 34*b* have a width "Wb" and a height "Hb". The width Wb is selected to help achieve secure connection with the swaddling accessory 12. For example, the width Wb can be between about 4.0 inches and about 5.0 inches. The height Hb is also selected to help achieve secure connection with the swaddling accessory 12 and also to allow adjustment of the height of the swaddling accessory 12 on the blanket 10. For example, the height Hb can be between about 3.0 inches and about 4.0 inches.

Figure 2:
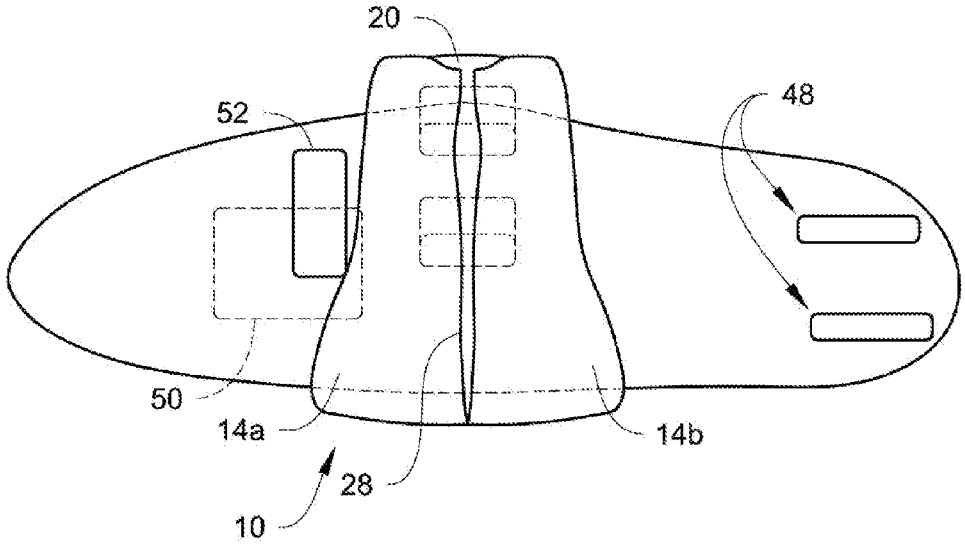
FIG. 2 is a front view of a wearable blanket together with a swaddling accessory attached to the wearable blanket in a second, "low" position.
Figure 3:
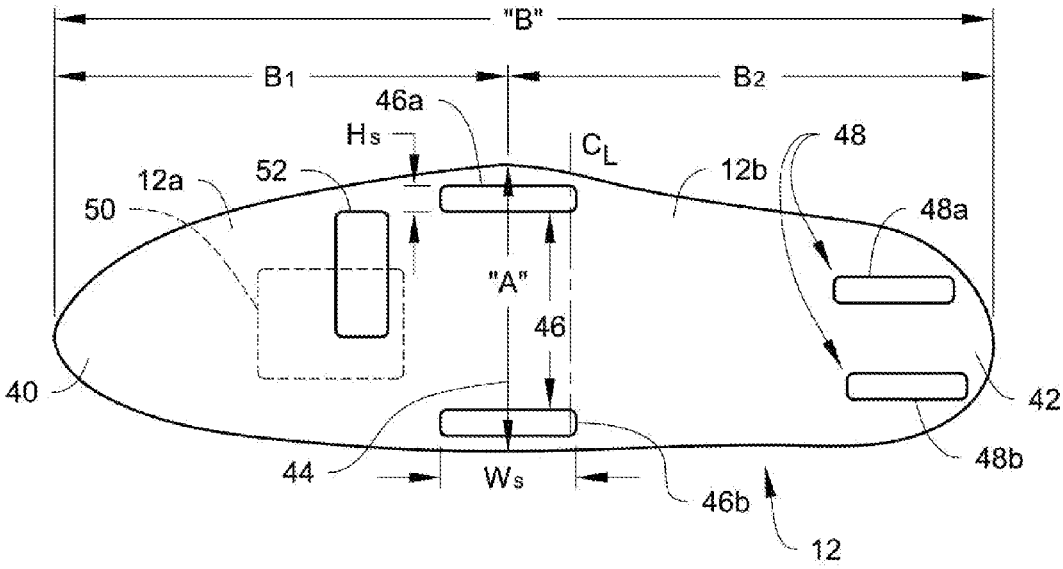
FIG. 3 is a front view of the swaddling accessory detached from the wearable blanket.

With reference to FIGS. 1-3, the swaddling accessory 12 is an elongated strip of material having a longitudinal axis La, a maximum length dimension B and a maximum height dimension A. The dimension B is selected to fully wrap an infant that fits the size, while the dimension A is selected to the length of a typical baby for that size. For example, for a "preemie" infant, the dimensions of B and A can be about 31 inches and about 13 inches, respectively. The accessory 12 is formed of a low-stretch material, for example cotton or fleece.

The accessory 12 is generally oval in shape, with rounded end regions 40, 42 and a portion 44 between the end regions 40, 42 with the maximum height A. The widest portion 44 is positioned generally to the left of a vertical centerline, $C_L$, of the accessory 12, and a portion 12*a* of the accessory to the left (when viewing FIG. 3) of the widest portion 44 has a length B1 which is less than the length B2 of a portion 12*b* to the right (when viewing FIG. 3) of the widest portion 44. Preferably, the maximum height A is chosen such that the swaddling accessory 12 will primarily cover the torso and arms of the infant, leaving the infant's legs free to flex within the wearable blanket 10. The dimension B is chosen such that the swaddling accessory 12 is long enough to fully and securely wrap the infant.

The accessory 12 has a fastener 46 positioned to cooperate with the fastener 34 on the blanket 10 for detachably connecting the swaddling accessory 12 to the blanket 10. For example, the fastener 46 comprises a pair of hook patches 46*a*, 46*b* forming part of a hook and loop fastening connection between the blanket 10 and swaddling accessory 12. Although separate patches 46*a*, 46*b* have been illustrated, it is to be realized that the fastener 46 could comprise a single hook patch, or the two patches 46*a*, 46*b* could be combined into a single larger hook patch. In addition, the hook and loop patches could be reversed, with the patches 34*a*, 34*b* being hook patches, and the patches 46*a*, 46*b* being loop patches.

The loop patches 46*a*, 46*b* have a width "Ws" and a height "Hs". The width Ws is approximately equal to the width Wb. However, the height Hs is less than the height Hb. For example, the height. Hs can be between about 1.0 inch to about 1.5 inch. With reference to FIGS. 1 and 2, the configuration of the patches 34*a*, 34*b*, 46*a*, 46*b* allow the swaddling accessory 12 to be positioned at different height positions relative to the blanket 10. FIG. 1 illustrates the swaddling accessory 12 positioned at a first, "high" position relative to the blanket 10 with the patches 46*a*, 46*b* secured to the patches 34*a*, 34*b* near the tops of the patches 34*a*, 34*b*. FIG. 2 illustrates the swaddling accessory 12 positioned at a second, "low" position relative to the blanket 10 with the patches 46*a*, 46*b* secured to the patches 34*a*, 34*b* near the bottoms of the patches 34*a*, 34*b*. It is to be realized that the swaddling accessory 12 can be positioned anywhere between the first and second positions, as well as at positions higher than the first position and lower than the second position.

Figure 6:
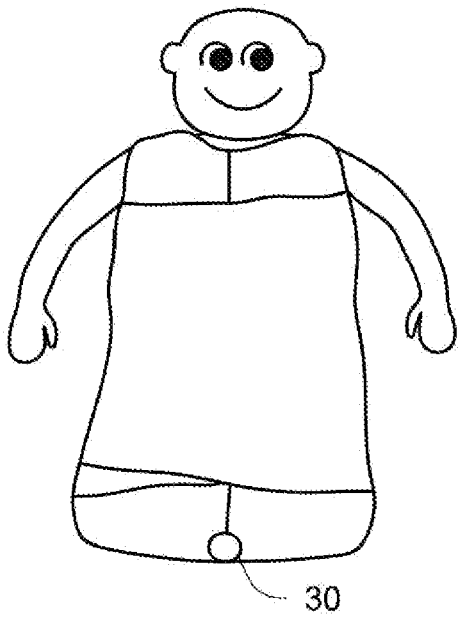
FIG. 6 illustrates the use of the wearable blanket and swaddling accessory on an infant with the swaddling accessory in the second, "low" position.

By adjusting the position of the swaddling accessory 12 relative to the blanket 10, the position of the swaddling that occurs on the infant can be changed as shown in FIGS. 5 and 6. The patches dictate the highest point that the swaddling accessory 12 can be fixed to the blanket 10 and prevents improper positioning of the swaddling accessory that could allow it to cover a portion of the infant's face. FIG. 5 illustrates the swaddling accessory 12 at the first, "high" position relative to the blanket 10. At this position, the swaddling accessory 12 extends over the arm holes 24, 26 and covers the infant's arms. FIG. 6 illustrates the swaddling accessory 12 at the second, "low" position relative to the blanket 10. At this position, the swaddling accessory 12 is below the arm holes 24, 26 and the infant's arms are free.

Returning to FIG. 3, the visible side of the accessory portion 12*b* has a fastener 48 adjacent the end region 42 for detachable engagement with a fastener 50 on the reverse side of the accessory portion 12*a* adjacent the end region 40. The fastener 50 is shown in dashed lines to indicate that it is on the surface opposite the surface that the fastener 48 is on.

The fastener 48 comprises, for example, a pair of hook panels 48*a*, 48*b*, while the fastener 50 comprises a loop panel. If desired, the hook and loop panels would be reversed, with the fastener 48 comprising the loop portion and the fastener 50 comprising the hook portion.

The panels 48*a*, 48*b* are long and narrow and the panel 50 preferably has a length greater than the length of the panels 48*a*, 48*b*. This allows adjustment of the swaddle accessory 12 around the infant.

An instruction panel 52 can also be provided on the accessory 12 providing instructions on how to swaddle an infant using the accessory 12 and other instructions on using the accessory 12.

The invention claimed is:

1. A swaddling accessory and a wearable blanket, comprising in combination:

the swaddling accessory includes an elongated strip of material having a first end and a second end, an interior surface that faces an infant's body when swaddled, an exterior surface, a longitudinal axis extending from the first end to the second end, wherein the length of the strip from the first end to the second end is sufficiently long to swaddle an infant, and a first fastener located on the interior surface for detachable engagement with the wearable blanket, the swaddling accessory having a widest portion that is at least 13 inches in height; and the wearable blanket includes a sack portion having a closed bottom edge, a partially closed top with a hole through which an infant's neck extends, two partially closed sides with arm holes through which an infant's arms extend, a front surface and a rear surface; and an opening with a closure mechanism on the front surface; and a fastener on the rear surface positioned for detachable engagement with the first fastener on the swaddling accessory, whereby the swaddling accessory is detachably connected to the wearable blanket by engaging the first fastener on the swaddling accessory with the fastener on the wearable blanket;

wherein the fasteners comprise hook and loop fasteners.

2. The swaddling accessory and the wearable blanket in claim 1, wherein the first fastener is located proximate a central portion of the elongated strip, the interior surface including at least one second fastener proximate one of the first end and the second end, and the exterior surface including at least one third fastener positioned for engagement with the at least one second fastener.

3. The swaddling accessory and the wearable blanket in claim 1, wherein the elongated strip has a vertical centerline, a top edge, and a bottom edge, and a widest portion measured between the top and bottom edges of the elongated strip, with the widest portion being offset from the vertical centerline.

4. A wearable blanket, comprising:

a wearable blanket having a sack portion that has a closed bottom edge, a partially closed top with a hole through which an infant's neck extends, two partially closed sides with arm holes through which an infant's arms extend, a front surface and a rear surface, a distance measured between the top and the bottom edge; and an opening with a closure mechanism on the front surface; and a swaddle connected to the wearable blanket, the swaddle including an elongated strip of material that has: a first end and a second end, an interior surface that faces an infant's body when swaddled, an exterior surface, a longitudinal axis extending from the first end to the second end, wherein the length of the strip from the first end to the second end is sufficiently long to swaddle an infant, a top edge and a bottom edge, and a widest portion measured between the top and bottom edges of the swaddle; wherein the widest portion is greater than half of the distance between the top of the wearable blanket and the bottom edge of the wearable blanket; and wherein the elongated strip of material has a vertical centerline, and wherein the widest portion of the strip is offset from the vertical centerline.

5. A swaddling accessory and a wearable blanket, comprising in combination:

the swaddling accessory includes an elongated strip of material having a first end and a second end, an interior surface that faces an infant's body when swaddled, an exterior surface, a longitudinal axis extending from the first end to the second end, wherein the length of the strip from the first end to the second end is sufficiently long to swaddle an infant, and a first fastener located on the interior surface for detachable engagement with the wearable blanket, the swaddling accessory having a widest portion that is at least 13 inches in height; wherein the elongated strip has a vertical centerline, a top edge, and a bottom edge, and a widest portion measured between the top and bottom edges of the elongated strip, with the widest portion being offset from the vertical centerline; and the wearable blanket includes a sack portion having a closed bottom edge, a partially closed top with a hole through which an infant's neck extends, two partially closed sides with arm holes through which an infant's arms extend, a front surface and a rear surface; and an opening with a closure mechanism on the front surface; and a fastener on the rear surface positioned for detachable engagement with the first fastener on the swaddling accessory, whereby the swaddling accessory is detachably connected to the wearable blanket by engaging the first fastener on the swaddling accessory with the fastener on the wearable blanket.

* * * * *